United States Patent [19]

Kiang et al.

[11] Patent Number: 4,853,164

[45] Date of Patent: Aug. 1, 1989

[54] METHOD OF PRODUCING HIGH STRENGTH FIBERS

[75] Inventors: Joseph K. Kiang, Los Altos; Patrick K. C. Tsou, Half Moon Bay; Christine E. Vogdes, Mountain View, all of Calif.

[73] Assignee: Raychem Corporation, Menlo Park, Calif.

[21] Appl. No.: 219,675

[22] Filed: Jul. 15, 1988

Related U.S. Application Data

[60] Division of Ser. No. 47,557, Apr. 27, 1987, Pat. No. 4,778,633, which is a continuation of Ser. No. 718,143, Apr. 1, 1985, abandoned.

[51] Int. Cl.[4] ..... D02J 1/22

[52] U.S. Cl. ..... 264/22; 264/127; 264/289.3; 264/290.5

[58] Field of Search ..... 264/22, 127, 236, 237, 264/210.8, 210.2, 211.14, 211.17, 347, 348, 289.3, 290.5

[56] References Cited

U.S. PATENT DOCUMENTS

| | | | |
|---|---|---|---|
| 3,081,485 | 3/1963 | Steigerwald . | |
| 3,886,056 | 5/1975 | Kitanmaru et al. | 264/22 |
| 4,264,490 | 4/1981 | Berejka | 264/289.3 |
| 4,670,527 | 6/1987 | Mizuno | 264/210.8 |

*Primary Examiner*—James Lowe

*Attorney, Agent, or Firm*—Yuan Chao; Edith A. Rice; Herbert G. Burkard

[57] ABSTRACT

High strength fibers of polymeric material and having outstanding tensile strength, Young's modulus values, and creep resistance are prepared by treating a fiber from a polymeric material, which may contain a crosslinking promoter, by (a) crosslinking the polymeric material; (b) heating the fiber to a temperature, $T_1$, which (i) in the event the polymer is amorphous, is above the glass transition temperature (Tg) of the polymer and, (ii) in the event the polymer is crystalline, is above the second order transition temperature, $T_{\alpha c}$, and below the crystalline melting temperature (Tm) of the polymer; (c) drawing the fiber to a draw ratio of at least about 2 at a rate of at least about 200% per minute and (d) cooling the fiber.

15 Claims, 7 Drawing Sheets

METHOD OF PRODUCING HIGH STRENGTH FIBERS

CROSS-REFERENCE TO RELATED APPLICATIONS

This application is a divisional of application Ser. No. 07/047,557, filed Apr. 27, 1987, and now U.S. Pat. No. 4,778,633, which is a continuation of application Ser. No. 06/718,143, filed Apr. 1, 1985, now abandoned, the disclosures of which are incorporated herein by reference.

BACKGROUND OF THE INVENTION

This invention relates to a method of producing a high strength fiber and to a high strength polyethylene fiber so produced.

For various uses, fibers having higher than usual strength are required. For example, the fibers used in fiber reinforced articles, and load bearing devices such as ropes, etc., should be strong. Typically the fibers used are of glass, carbon, steel or the like. For some uses it is desirable that the fiber also have the ability to deform or elongate. Polymeric fibers have the desirable elongation, however, commercially available, polymeric fibers generally have insufficient strength for many uses.

Various processes have been proposed in the art to improve the strength of polymeric fibers. One such process is a gel crystallization technique, another is solid state extrusion. These processes while they do provide polymeric fibers of improved strength are undesirably slow. Further, the fibers exhibit low elongation and are subject to irreversible creep when subjected to high forces.

Crosslinking of polymeric fibers by irradiation has been proposed. It ha been found that if polymeric fibers are stretched to increase their strength by orientation and then irradiated the physical properties of the polymer tend to degrade. There are reports in the literature of crosslinking the polymeric material of the fibers before stretching. However, the technique employed in the prior art resulted only in a relatively modest improvement in the strength of the fibers.

This invention provides a method of producing high strength polymeric fibers having unique properties. The resulting fibers can be used for making fabrics and articles such as garments, and for producing reinforced articles such as fiber reinforced composites and the like. Further the fibers are heat-shrinkable, that is, on application of heat, generally to a temperature of about $T_1$ (as herein defined), the fibers shrink toward their undrawn dimension. The fibers thus can be used to produce heat-shrinkable articles and composites.

SUMMARY OF THE INVENTION

One aspect of this invention comprises a method of treating a fiber of polymeric material which comprises the steps of:

(a) crosslinking the polymeric material;

(b) heating the fiber to a temperature, $T_1$, which (i) in the event the polymer is amorphous, is above the glass transition temperature, Tg, of the polymer and, (ii) in the event the polymer is crystalline, is above the second order transition temperature, $T_{\alpha c}$, and below the crystalline melting temperature, Tm, of the polymer;

(c) drawing the fiber to a draw ratio of at least about two at a rate of at least about 200% per minute; and (d) cooling the fiber.

Another aspect of this invention provides a polyethylene fiber which (a) has a tensile strength of at least about 70,000 psi, and (b) when subjected to a stress of 15,000 psi at 25° C. for at least 1 hour, thereby causing the polymer to deform, is capable of substantially complete recovery to its undeformed configuration when said stress is removed.

DETAILED DESCRIPTION OF THE INVENTION

Figure 1:
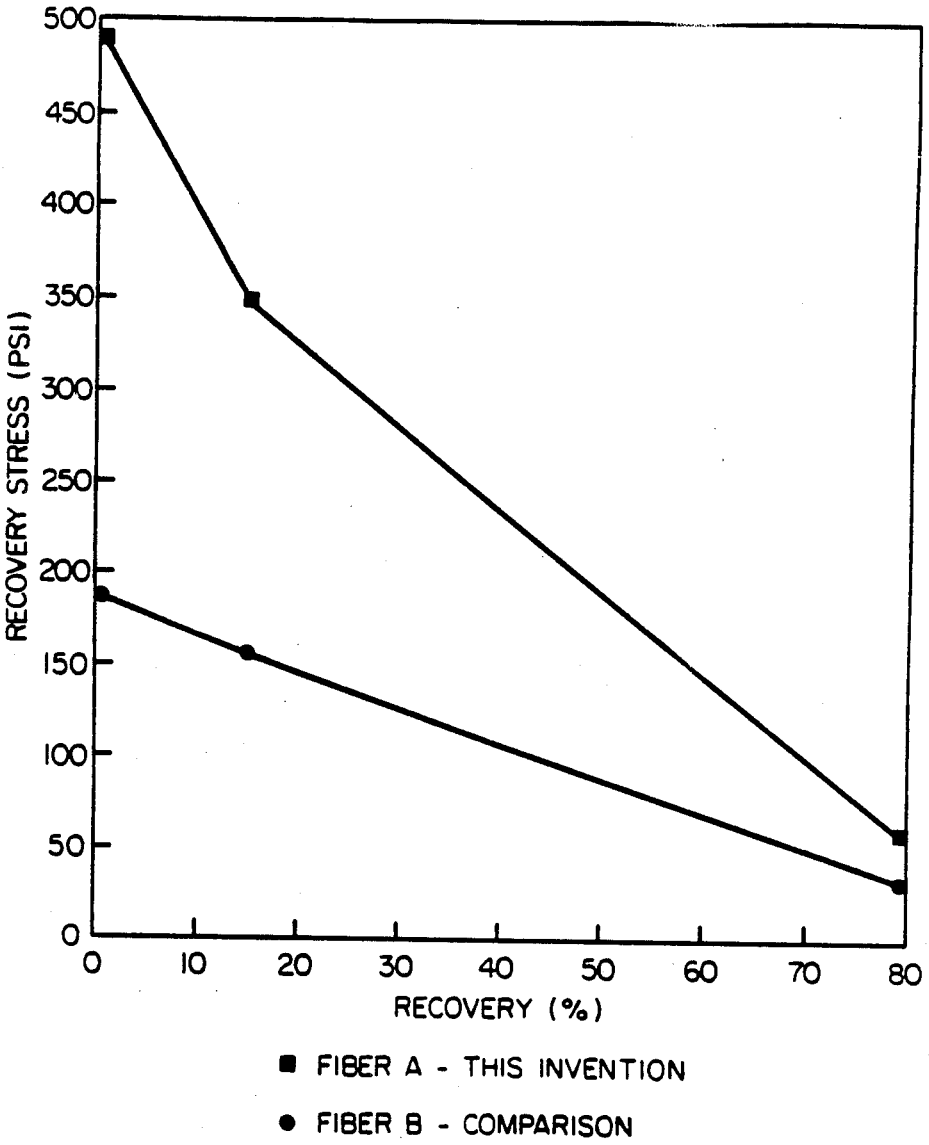
FIG. 1 is a graph showing the effect of the order in which drawing and crosslinking takes place on the recovery stress exhibited by the fibers versus the degree of recovery at 150° C.

The fibers modified in accordance with this invention are comprised of a polymeric material. The polymeric material may be amorphous or crystalline. The terms crystalline and crystalline polymer are used herein to mean polymers which are at least partially crystalline. Preferred materials are crystalline polymers, for example, polyolefins such as polyethylene, polyamides, such as polyepsiloncaprolactam (nylon 6) polyundecanoamide (nylon 11), and polydodecanoamide (nylon 12), fluoropolymers, such as polyvinylidene fluoride and ethylene-tetrafluoroethylene copolymers, polyesters, such as polybutylene terephthalate, and the like. Preferred polymers are high density polyethylene and polyvinylidene fluoride.

The polymer used should be of high molecular weight, the particular molecular weight preferred varies with the different polymers. For polyethylene the weight average molecular weight should be at least about 50,000 preferably at least about 80,000 and most preferably at least about 100,000.

It is preferred that the polymer have a relatively narrow molecular weight range. The molecular weight distribution (MWD) is the weight average molecular weight (Mw) divided by the number average molecular weight (Mn), that is $$MWD=Mw/Mn$$

In general, for polyethylene, the molecular weight distribution should be in the range of about 1 to about 15, preferably about 2 to about 10 and most preferably about 2 to about 5.

The fiber can be formed initially by any fiber forming technique. The polymer can be melt-spun, or spun from a solution using conventional apparatus and processing conditions.

After formation of the fiber, while it is in a substantially undrawn state, the polymeric material is crosslinked. By substantially "undrawn" is meant that the fiber is not subjected to a drawing process following formation thereof. Crosslinking preferably is effected by irradiation, for example, by passing the fibers through an electron beam, or an ultraviolet source. The dose of irradiation depends on the particular polymer employed, the presence of absence of a cross-linking promoter, as discussed below, and the particular crosslinking promoter/polymer combination employed. Typically the irradiation dose for polyethylene fibers is about 2 to about 35 Mrads, preferably about 2 to about 25 Mrads and most preferably about 2 to about 18 Mrads.

A crosslinking promoter may be added to the polymeric material. For polymeric materials other than polyethylene, it is generally preferred to add a crosslinking promoter. Crosslinking promoters for use with polymers include, for example, the polyallyl esters of carboxylic acids and other acid moieties such as cyanuric acid, e.g., triallyl cyanurate, triallyl citrate, triallyl citrate acetate, or triallyl isocyanurate; N,N'-ethylenebismaleimide and N,N'-phenylene-bis-maleimide; acrylic and methacrylic esters of polyhydric alcohols, e.g., dipentaerythritol hexamethacrylate; vinyl esters of polybasic acids, e.g., trivinyl cyanurate and trivinyl citrate; vinyl and allyl ethers of polyhydric alcohols, e.g., the tetraallyl ether of pentaerythritol and the tetravinyl ether of pentaerythritol; bis acrylamides, e.g., N,N'-methylenebis-acrylamide and N,N'-p-phenylenebis-acrylamide. Preferred crosslinking promoters are triallyl isocyanurate and triallyl cyanurate.

The polymeric materail may also contain additives such as stabilizers, pigments, flame retardants and the like.

The radiation dose and crosslinking promoter, if present, should be selected to provide the desired crosslinking density. Crosslinking density can be determined by measuring the gel content of the polymer. The polymer should be sufficiently crosslinked to have a gel content of at least about 5% by weight, preferably at least about 15% by weight and most preferably above about 25% by weight. The extent of crosslinking may also be determined by measuring the elastic modulus of the crosslinked material at a temperature above the polymer melting point, as described more fully below.

After the polymeric material of the fiber is crosslinked, the fiber is drawn at elevated temperature. The temperature, $T_1$, at which the fiber is drawn depends on the particular polymeric material. If the polymeric material is amorphous, the drawing temperature, $T_1$, should be above the glass transition temperature, Tg, of the polymer. For amorphous polymers, the drawing temperature $T_1$ can be any temperature above Tg at which the polymer is self-supporting and capable of being processed. Generally, the drawing temperature, $T_1$, will be lower than the conventional extrusion temperature used for that polymer.

For crystalline polymers the drawing temperature, $T_1$, should be above the second order transition temperature, Tαc and below the crystalline melting temperature, Tm, of the polymer. $T\alpha_c$ is a premelting transition temperature at which semicrystalline polymers show a mechanical loss peak, as measured by mechanical spectroscopy. At this temperature hindered rotation of the polymer chains inside the polymer crystallites can occur. In the case of polyethylene, the drawing temperature should be between about 80° to about 130° C., preferably between about 90° and about 120° C. and most preferably about 100° to about 120° C. The appropriate temperature at which to draw fibers of other polymers can be readily determined without undue experimentation, by one skilled in the art following the guidelines set forth above.

In drawing the fiber, it has been found that the fiber should not be permitted to stress relax to a significant degree during the step of drawing the fibers. If the fiber is permitted to stress relax during drawing of the fiber the dramatic improvement in strength provided by treating the fiber in accordance with this invention will not be realized. To minimize relaxation of the fiber, the fiber should be drawn at least about 200% per minute, preferably at least about 2000% per minute and most preferably at least about 15,000% per minute.

The fiber should be drawn to a draw ratio of at least about two, that is, to at least about twice its initial length. Generally, the higher the draw ratio, up to the breaking point of the fiber, the stronger the fiber will be. For polyethylene, it is preferred to draw the fiber at least about 8X and preferably at least about 10X of its initial pre-drawn length.

After drawing the fiber it is cooled to ambient temperature. Cooling is generally effected by air cooling. The fiber can however be run through a bath of cold water if mroe rapid cooling is desired.

Generally the fibers treated in accordance with this invention should be monofilaments having a diameter after drawing in the range of about 1.0 to about 25 mils. It is to be understood that the diameter of the fiber prior to drawing will be larger than this and in some instances the initial fiber is essentially a rod.

The fibers of this invention have desirable tensile strength, Young's modulus, elongation and creep properties making them useful for a variety of applications.

The value of tensile strength varies depending on the polymer used. For polyethylene the tensile strength is above 70,000 psi (pounds per square inch), preferably about 100,000 psi and most preferably above 120,000 psi. The Young's modulus for polyethylene fibers treated in accordance with this invention is greater than about 500,000 psi, preferably greater than about 1,000,000 psi and most preferably greater than about 1,200,000 psi. The elongation of polyethylene fibers of this invention have an elongation of at least about 2%, preferably at least about 10% and most preferably at least about 15%.

Polyethylene fibers treated in accordance with the method of this invention are novel and are particularly resistant to creep, that is resistant to permanent deformation when a force is applied and further, are capable of substantially complete recovery from any stress induced deformation. A particularly useful demonstration of the ability of the fiber of this invention to recover from deformation is to subject the fiber to a stress of 15,000 pounds per square inch (psi) at 25° C. for about one hour and then remove the stress. The polyethylene fibers of this invention are capable of substantially complete recovery from the deformation induced by the 15,000 psi stress.

All fibers treated in accordance with this invention show improved creep resistance compared with fibers of the same polymeric material which have not been so treated. The creep resistance of the fibers makes them particularly useful for load bearing applications, such as in the manufacture of ropes or the like.

The fibers prepared in accordance with this invention can be used in any fiber application particularly, where high strength is desired. For example, they can be used to prepare fabrics and garment such as bullet proof vests. The fibers have been drawn at least about 200% at $T_1$. Upon reheating of the fibers to about $T_1$, the fibers will recover toward their pre-drawing dimension. Fabrics in the form of a sleeve or other shape can be positioned around a substrate and heated to cause them to shrink into contact with the substrate. Such fabrics can be in the form of braids, woven fabrics, knitted articles or the like. All fibers of the fabric can be fibers of this invention or such fibers can be used together with any other fiber to produce the desired properties. In one configuration, a woven fabric having metal filaments or fibers in one direction and fabrics of this invention in the other can be prepared. Such fabrics in the form of a tube in which the metal fibers extend longitudinally and the fibers of this invention are radially dispersed can be positioned over a tubular substrate such as an electrical cable. When heat is applied, the fabrics of this invention shrink into contact with the substrate. The longitudinally extending metal fibers are brought closer together by shrinking of the radial fibers and act to shield the electrical substrate. Such articles are described in U.S. Pat. No. 4,639,545, the disclosure of which is incorporated herein by reference.

The fibers prepared in accordance with this invention can be used as reinforcement of various materials such as thermoplastic and thermosetting resins, concrete, metal structures and the like. The fibers generally will be utilized at temperatures below $T_1$ and the fiber remains in the drawn configuration.

The fibers can also be used together with a polymer matrix in which their heat shrinkability is utilized. Articles employing heat shrinkable fibers are desribed in U.K. published patent specification No. 2,135,632, the disclosure of which is incorporated herein by reference.

The following examples illustrate the preparation of typical fibers of this invention and properties of such fibers.

EXAMPLE 1

This example compares polyethylene fibers prepared in accordance with this invention, utilizing electron radiation to crosslink the polymer before drawing, with polyethylene fibers prepared by irradiation after drawing.

Fibers of polyethylene (of Alathon 7030, commercially available from duPont) containing 0.5% of a crosslinking promoter were spun on conventional melt spinning equipment. Fiber A, which is an example of the instant invention, was irradiated using an electron accelerator to a radiation dosage of 5.3 Mrads, heated to 120° C. and then drawn 10 times its original length. Fiber B, which is not an example of this invention, was drawn 10 times its original length at 120° C. and then irradiated to a dose of 5.3 Mrad with electrons from an electron accelerator. The tensile strength, elongation and Young's modulus were measured in accordance with the procedures of ASTM D638, incorporated herein by reference. The results are given in Table I.

TABLE I

| | Fiber A | Fiber B |
|---|---|---|
| Tensile Strength (psi) | 80,000 | 62,000 |
| Elongation (%) | 15 | 40 |
| Young's Modulus (psi) | 213,000 | 201,000 |

The recovery stress and creep resistance of Fibers A and B were also determined as described below.

Fibers A and B were mounted in the jaws of an Instron to maintain the fibers at a given length and then heated to a temperature (150° C.) above the melting point of polyethylene. At this temperature the fibers would tend to shrink, or recover, toward their undrawn length if not restrained by the Instron jaws. After 5 minutes the stress on the fiber caused by the tendency to recover (recovery stress) was measured. The results are shown in the graph of FIG. 1. As illustrated in the graph, Fiber A of this invention exhibits significantly greater recovery stress than Fiber B.

Figure 2:
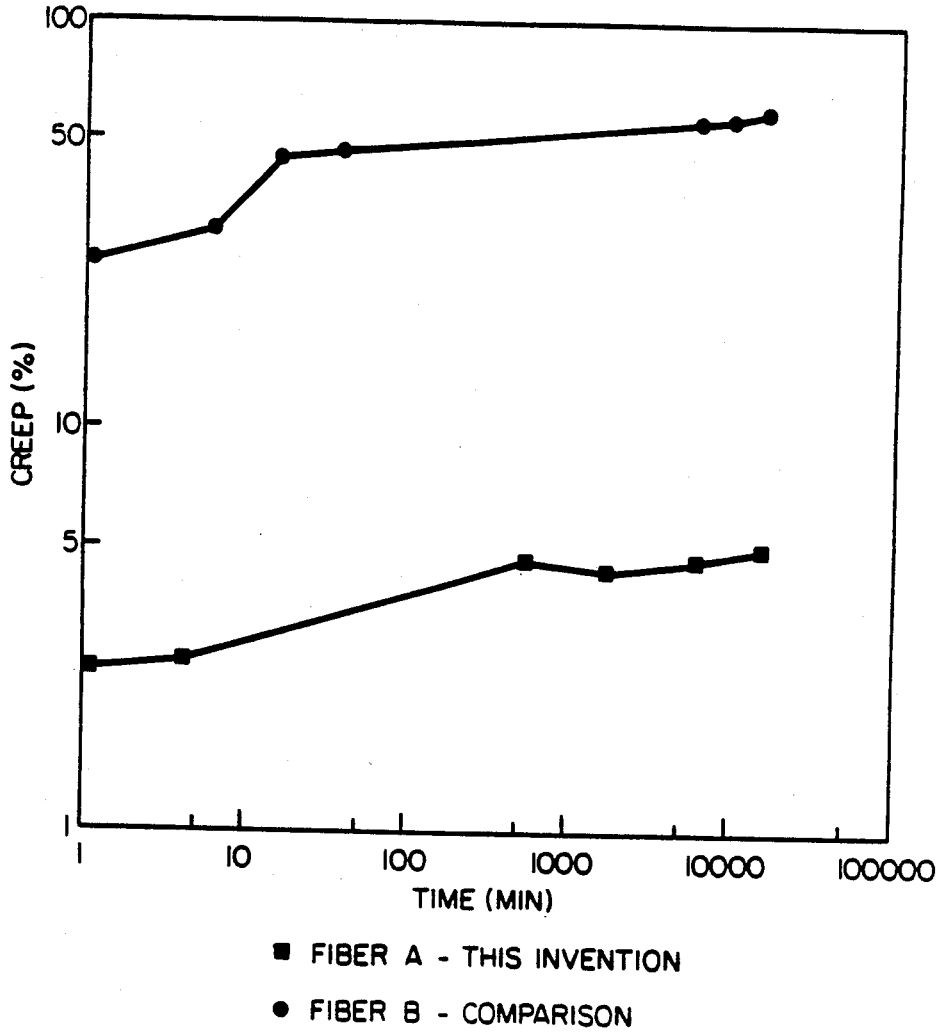
FIG. 2 is a graph showing the effect of the order in which drawing and crosslinking takes place on creep resistance of the fibers at 60° C. after they have been recovered at 150° C. to 85% of their drawn length.

Fibers A and B were heated to 150° C. and permitted to recover (shrink) 15% of the drawn length and then cooled to room temperature. The creep resistance at 60° C. of the recovered fibers was determined by heating the fibers to 60° C. and subjecting them to a stress of 2,000 psi and measuring the extent of deformation of the fibers. The results are shown in the graph of FIG. 2. As illustrated in the graph, Fiber A of this invention exhibits significantly greater resistance to creep at 60° C. than does Fiber B.

EXAMPLE 2

This example illustrates the room temperature creep resistance of polyethylene Fibers A which have been crosslinked then stretched in accordance with this invention, and B which have been stretched then crosslinked and fibers of other polymers prepared in accordance with this invention compared with fibers not so prepared.

Figure 3:
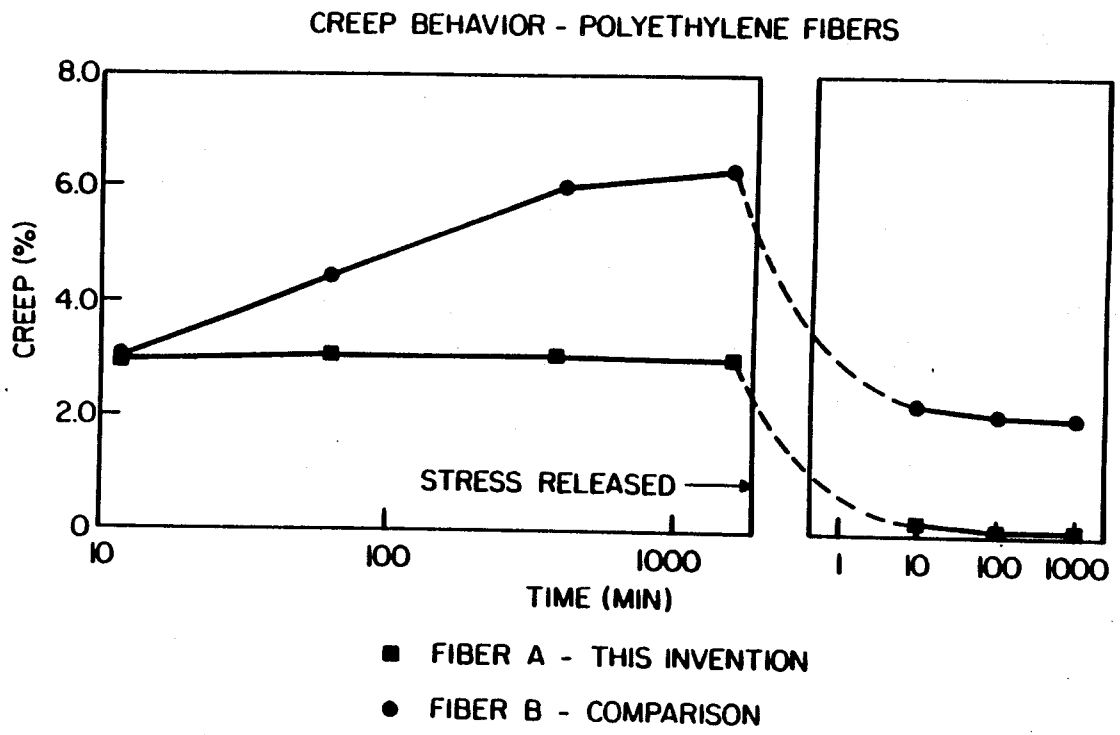
FIG. 3 is a graph showing room temperature creep properties of polyethylene fibers of this invention compared to other polyethylene fibers. In particular it shows that when polyethylene fibers of this invention are subjected to a stress of 15,000 psi at 25° C. for at least one hour causing the fiber to deform or creep and then are released from such stress, are capable of substantially complete recovery while fibers not of this invention do not exhibit this property.

Fibers A and B as prepared in Example 1 were tested for creep resistance at room tempeature under an applied stress of 15,000 psi. The stress was released after 1,000 minutes and the recovery from creep was measured. The results are shown in the graph of FIG. 3. In this graph it is shown that Fiber A exhibits little, if any, creep after initial elastic deformation in the first 10 minutes and after the applied stress is released, recovers substantially completely to its original configuration. A similar fiber which had been drawn to 10 times it original length was also tested for creep resistance at room temperature under an applied stress of 15,000 psi. This fiber, which was typical of the prior art, elongated slowly but continuously when stressed (9% creep after 1,000 minutes) and ruptured shortly thereafter.

Figure 4:
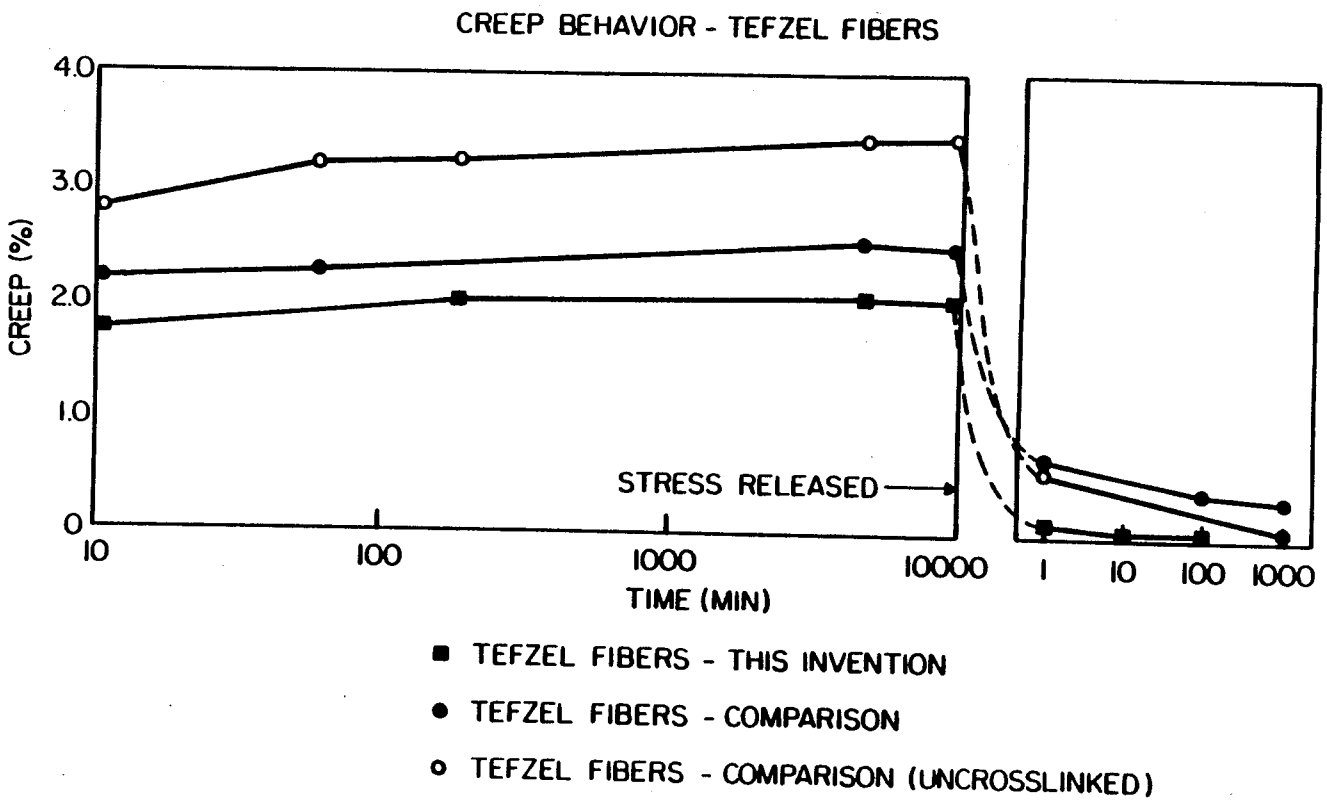
FIG. 4 is a graph showing room temperature creep properties of TEFZEL fibers of this invention compared to other TEFZEL fibers.

FIG. 4 shows the creep behavior of ethylenetetrafluoroethylene copolymer (TEFZEL) fibers of the instant invention (6X draw ratio) compared with both identically drawn uncrosslinked and subsequently crosslinked fibers of the same original composition.

Figure 5:
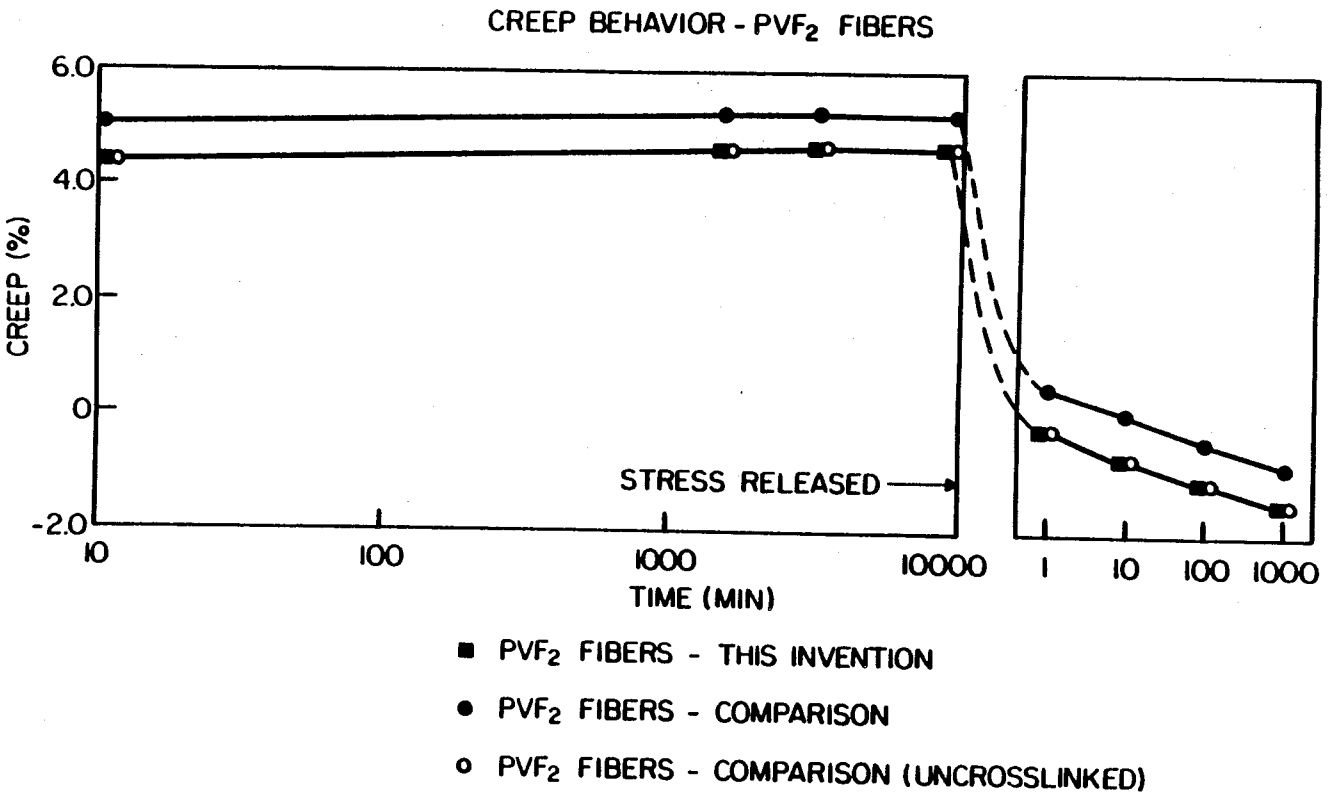
FIG. 5 is a graph showing room temperature creep properties of $PVF_2$ fibers of this invention compared to other $PVF_2$ fibers.

FIG. 5 shows the creep behaviour of $PVF_2$ fibers of the invention (5X draw ratio) compared with both identically drawn uncrosslinked and subsequently crosslinked fibers of the same original composition.

Figure 6:
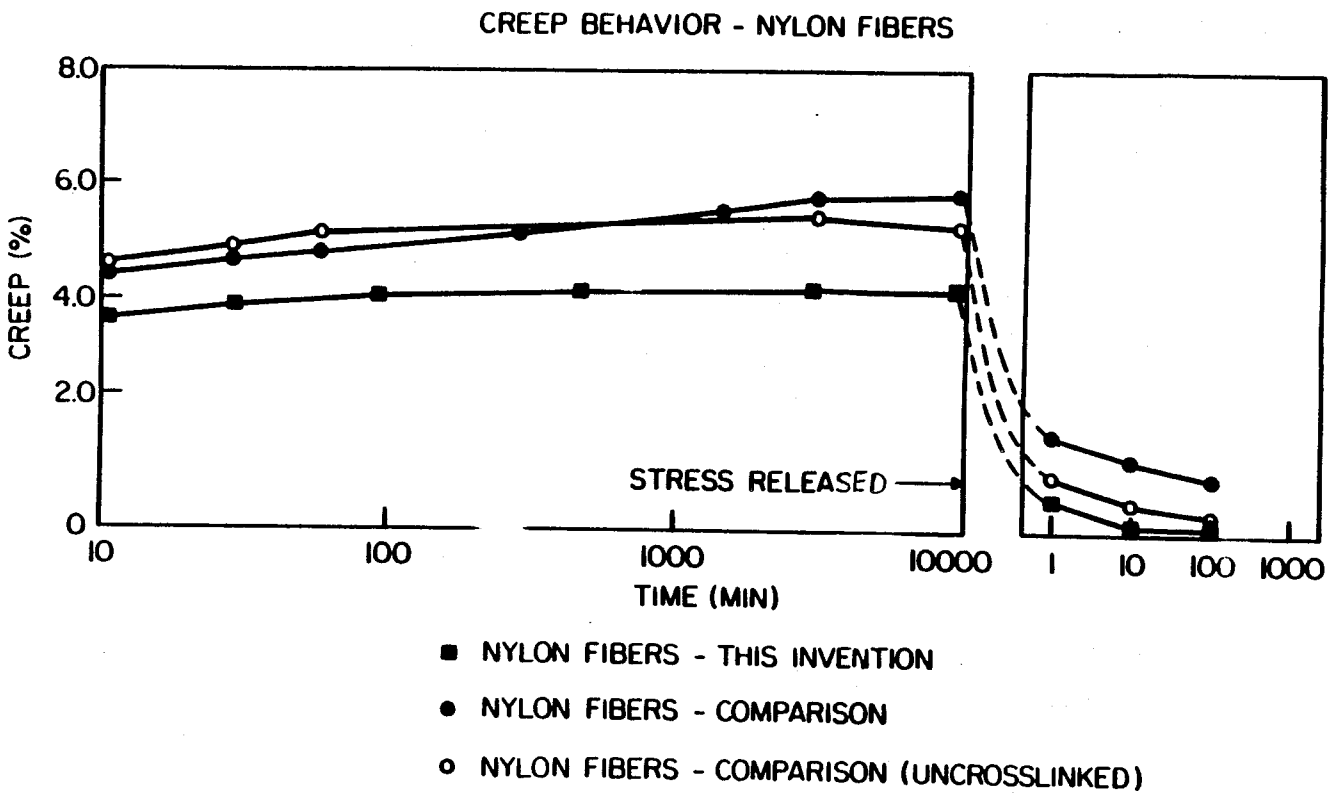
FIG. 6 is a graph showing room tempeature creep properties of nylon fibers of this invention compared to other nylon fibers.

FIG. 6 shows the creep behavior of Nylon-12 fibers of the invention (4.5X draw ratio) compared with both identically drawn uncrosslinked and subsequently crosslinked fibers of the same original composition.

EXAMPLE 3

This example illustrates the effect of drawing temperature, $T_1$, on polyethylene fiber properties.

Polyethylene fibers in a substantially undrawn state containing 0.5% crosslinking promoter were irradiated to a dose of about 4 Mrads by passing them through a beam of 0.8 Mv electrons. Samples of the irradiated fibers were heated to a drawing temperature, $R_1$, of 80°, 100°, 120° and 130° C. in a glycerine bath and drawn to 10 times their original length. The room temperature tensile strength for each fiber sample was determined using the procedure specified in ASTM D638, which is incorporated herein by reference. The results obtained are:

| Sample | $T_1$ °C. | Tensile Strength (psi) |
|---|---|---|
| C | 80 | 8,100 |
| D | 100 | 92,000 |
| E | 120 | 94,000 |
| F | 130 | 92,000 |

The fibers were heated to a temperature of about $T_1$ causing them to attempt to shrink, or recover, toward their undrawn configuration. The recovery stress was determined by mounting the samples in the jaws of an Instron Tensile Tester placed in an oven and constraining them from recovering, the resultant stress being measured.

The results are:

| Sample | $T_1$ °C. | Recovery Stress (psi) |
|---|---|---|
| C | 80 | 275 |
| D | 100 | 500 |
| E | 120 | 500 |
| F | 130 | 450 |

These results indicate that for polyethylene the drawing temperature should be, for example, above about 100° C., that is above $T_{\alpha c}$, to obtain the advantageous results of this invention.

EXAMPLE 4

This example illustrates the advantage of using a polymer with a narrow molecular weight distribution in preparing fibers of this invention.

Fibers G and H were prepared from vinylidene fluoride polymers ($PVF_2$) of different molecular weight distributions. Fiber G of Solef 1012 having a relatively narrow molecular weight distribution compared to Fiber H of Kynar 460. The fibers, which both contained 0.5% crosslinking promoter, were crosslinked by irradiation to a dose sufficient to provide a hot modulus $M_{100}$ of 18. This modulus test measures the stress required to elongate a resin by 100% at a temperature between the decomposition temperature and the crystalline melting point for $PVF_2$. The modulus measurement expressed as the $M_{100}$ value can be calculated by:

$$M_{100} = \frac{\text{stress in pounds to elongate sample by 100\%}}{\text{initial cross-sectional area in square inches}}$$

Should the sample rupture prior to 100% elongation, the $M_{100}$ is calculated using the equation:

$$M_{100} = \frac{\dfrac{\text{stress in pounds to elongate sample by 100\%}}{\text{elongation at rupture}}}{\text{initial cross-sectional area in square inches}}$$

The fibers were then heated to 150° C., which is above the $T_{\alpha c}$ of $PVF_2$ and drawn 5 times their original length. The tensile strength and elongation were measured in accordance with ASTM D638. The results obtained are:

| Fiber | Tensile Strength (psi) | Elongation (%) |
|---|---|---|
| G | 109,000 | 25 |
| H | 79,000 | 20 |

EXAMPLE 5

Figure 7:
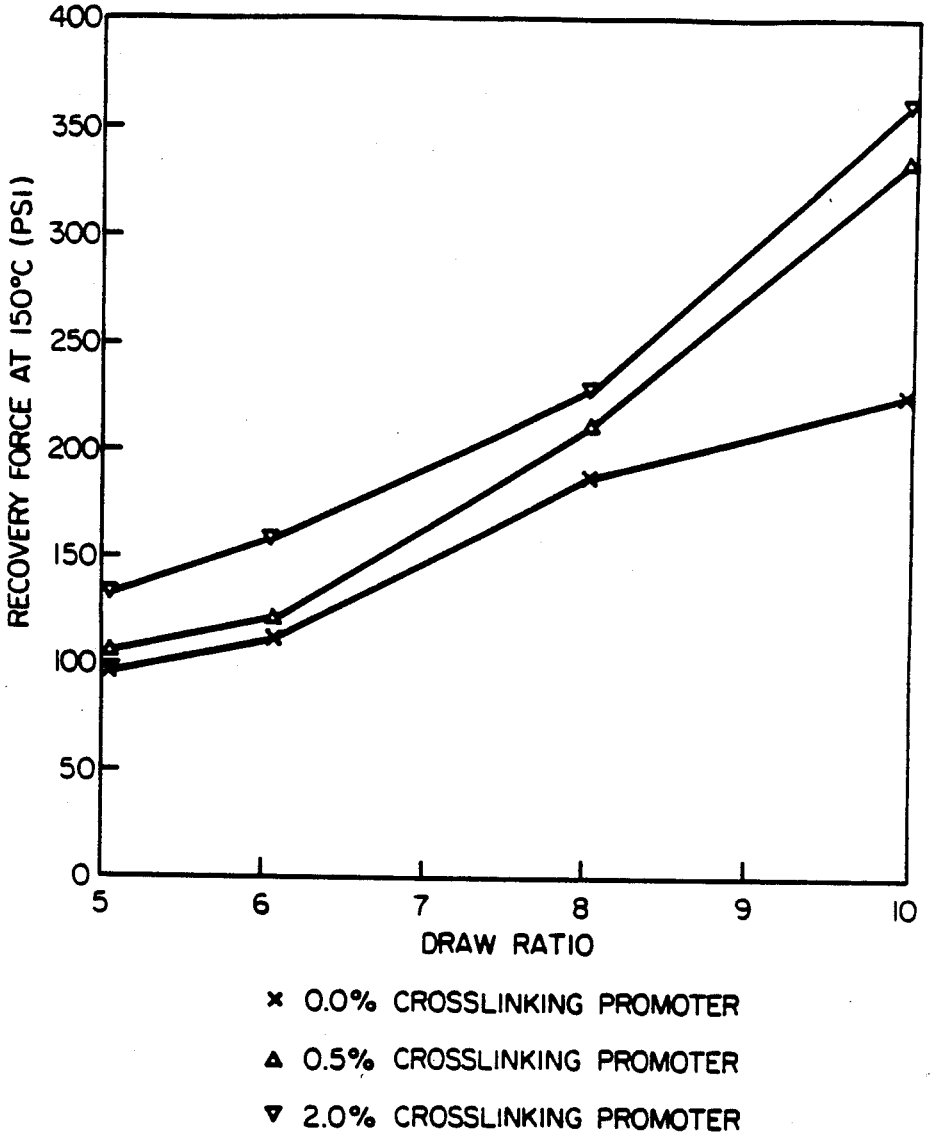
FIG. 7 is a graph showing the recovery force increase in fibers of this invention with increasing amounts of crosslinking promoter and higher draw ratios.

This example illustrates the effect of varying amounts of crosslinking promoter in ultra-violet crosslinked polyethylene fibers of this invention. Polyethylene containing 0.5 percent 1,4-dichlorobenzophenone and 0, 0.5 and 2.0 percent triallylisocyanurate were crosslinked by exposure to ultra-violet radiation. The fibers were then drawn 5X, 6X, 8X or 10X and the recovery force measured as described in Example 1. The results are shown in the graph of FIG. 7.

EXAMPLE 6

This example illustrates one manner of orienting polyethylene taught in the prior art and thus is not an example of the instant invention. Samples of Marlex 6006 ($M_n$ $1.52\times10^4$ $M_w/M_n$ 7.25) fibers were manually stretched to twelve times their original length in boiling water using tweezers, allowing them to relax periodically without tension during the drawing process. The resultant fibers had a tensile strength of about 60,000 psi.

EXAMPLE 7

This example illustrates the preparation of a typical fiber of this invention. Polyethylene fiber prepared from Alathon 7030 with addition of 0.5% of a crosslinking promoter and irradiated by high energy electron beam to provide a hot modulus $M_{100}$ of 21 psi. The crosslinked fiber was drawn continuously at 120° C. to 10 times its original length to a final diameter of 0.002 inch. The fiber has a room temperature tensile strength of $2.0\times10^5$ psi and Young's modulus of $1.2\times10^6$ psi and an ultimate elongation of 9%.

EXAMPLE 8

This example illustrates the treatment of ethylenetetrafluoroethylene (ETFE) copolymer fibers, polyvinylidene fluoride ($PVF_2$) fibers, polyethylene (PE) fibers and nylon 12 fibers in accordance with this invention.

Polymer compositions containing a crosslinking promoter were spun into fibers which were irradiated by means of an electron accelerator (E) by ultra-violet radiation (UV), as indicated in the following table, to provide an $M_{100}$, determined as described above, having the value listed in the following table. The fibers were heated to the draw temperature indicated, and drawn to the draw ratio given in the table. The room temperature tensile strength, ultimate elongation and Young's modulus were determined by ASTM D638. The results are given in the table.

| Polymer | Irradiation | $M_{100}$ psi | Draw Temp (C.°) | Draw Ratio | Tensile Str. (psi) | Elongation (%) | Young's Modulus (psi) |
|---|---|---|---|---|---|---|---|
| ETFE | E | 18 | 215° C. | 6X | 78,000 | 10 | 812,000 |
| $PVF_2$ | E | 18 | 150° C. | 5X | 109,000 | 25 | 330,000 |
| $PVF_2$ | E | 15* | 150° C. | 5X | 82,000 | — | — |
| PE | UV | 17 | 120° C. | 10X | 115,000 | 11 | 723,000 |
| PE | E | 14* | 120° C. | 10X | 110,000 | — | — |
| Nylon 12 | UV | 8 | 120° C. | 4X | 60,000 | 20 | 326,000 |

*These fibers did not contain a crosslinking promoter.

EXAMPLE 9

This example shows that while for uncrosslinked drawn fibers which are not part of the instant invention, better tensile strengths are obtained from polymers of high molecular weight and higher Mw/Mn ratio, best results, particularly at higher draw ratios, were obtained with crosslinked drawn fibers of the instant invention prepared using high molecular weight low Mw/Mn ratio of polyethylenes.

Fibers of substantially unoriented polyethylene containing a crosslinking promoter were prepared by melt spinning. One of the fiber samples as crosslinked by exposure to 5 Mrads or less of ionizing radiation from an electron accelerator.

The fibers were heated to 120° C. and drawn from 4 to about 14 times their original length. The tensile strength of the fibers is shown as a function of draw ratio in Table I.

TABLE I

| | | Cross-linked | Tensile Strength (psi × $10^{-3}$) at Draw Ratio of: | | | | |
|---|---|---|---|---|---|---|---|
| | Polyethylene | | 5 | 6 | 8 | 10 | 13 |
| I | Alathon 7030 | yes | 42 | 52 | 80 | 110 | 130 |
| J | Alathon 7030 | no | — | 37 | 52 | 84 | 102 |
| K | Marlex 6006 | no** | — | 47 | 68 | 89 | * |
| L | Hoechst GM9255 (Mn, 1.2 × $10^4$ Mw/Mn, 21) | no** | 37 | 44 | 78 | 86 | * |

*Samples broke at less than 13X draw ratio
**Irradiated samples gave results intermediate between those of the uncrosslinked fibers and I but ruptured at lower draw ratios.

While the invention has been described herein in accordance with certain preferred embodiments thereof, many modifications and changes will be apparent to those skilled in the art. Accordingly, it is intended by the appended claims to cover all such modifications and changes as fall within the true spirit and scope of the invention.

We claim:

1. A method of making a high strength, high creep recovery polymeric fiber, comprising the steps of:
   (a) providing a fiber of a polymeric material selected from the group consisting of polyvinylidene fluoride, ethylene-tetrafluoroethylene copolymer, polyamide, and polybutylene terephthalate;
   (b) crosslinking the polymeric material;
   (c) thereafter heating the fiber to a temperature $T_1$, which (i) in the event the polymeric material is amorphous, is above the glass transition temperature $T_g$ of the polymeric material and (ii) in the event the polymeric material is crystalline, is above the second order transition temperature $T_{\alpha c}$ and below the crystalline melting temperature $T_m$ of the polymeric material;
   (d) drawing the heated fiber to a draw ratio of at least about two at a rate of at least about 200% per minute; and
   (e) cooling the drawn fiber;

whereby a fiber is obtained which has a tensile strength of at least about 70,000 psi and which, when subjected to a stress of 15,000 psi at 25° C. for at least 1 hour, thereby causing the fiber to deform, is capable of substantially complete recovery to its undeformed configuration when the stress is removed.

2. A method according to claim 1 wherein in the crosslinking step the polymeric material is crosslinked by irradiation.

3. A method according to claim 1 wherein in the crosslinking step the polymeric material is crosslinked by subjecting it to irradiation from an electron beam accelerator at a dosage of about 2 to about 35 Mrads.

4. A method according to claim 2, wherein the polymeric material contains a crosslinking promoter.

5. A method according to claim 4, wherein the crosslinking promoter is comprises triallylisocyanurate.

6. A method according to claim 1, wherein in the crosslinking step the polymeric material is crosslinked by subjecting it to ultraviolet irradiation.

7. A method according to claim 1, wherein the polymeric material has a weight average molecular weight of at least about 50,000.

8. A method according to claim 1, wherein in the drawing step the fiber is drawn at least 8 times its initial length.

9. A method according to claim 1, wherein in the drawing step the fiber is drawn at least 10 times its initial length.

10. A method according to claim 1, wherein in the drawing step the fiber is drawn at a rate of at least 2,000% per minute.

11. A method according to claim 1, wherein in the drawing step the fiber is drawn at rate of at least 15,000% per minute.

12. A method according to claim 1 wherein the polymeric material comprises polyvinylidene fluoride.

13. A method according to claim 1 wherein the polymeric material comprises ethylene-tetrafluorethylene copolymer.

14. A method according to claim 1 wherein the polymeric material comprises polyamide.

15. A method according to claim 1 wherein the polymeric material comprises polybutylene terephthalate.

* * * * *